US009173436B2

(12) United States Patent
Crye

(10) Patent No.: US 9,173,436 B2
(45) Date of Patent: Nov. 3, 2015

(54) MOLLE COMPATIBLE LIGHTWEIGHT GARMENT

(75) Inventor: Caleb Clark Crye, Brooklyn, NY (US)

(73) Assignee: LINEWEIGHT LLC, Brooklyn, NY (US)

( * ) Notice: Subject to any disclaimer, the term of this patent is extended or adjusted under 35 U.S.C. 154(b) by 0 days.

(21) Appl. No.: 13/006,529

(22) Filed: Jan. 14, 2011

(65) Prior Publication Data

US 2012/0180184 A1 Jul. 19, 2012

(51) Int. Cl.

| | |
|---|---|
| ***A41D 13/00*** | (2006.01) |
| ***A45F 3/14*** | (2006.01) |
| ***A45F 5/02*** | (2006.01) |

(52) U.S. Cl.

CPC ..... *A41D 13/0007* (2013.01); *A41D 13/0012* (2013.01); *A45F 3/14* (2013.01); *A45F 5/02* (2013.01)

(58) Field of Classification Search

CPC ..... A41D 1/04; A41D 1/002; A41D 13/012; A41D 13/0007; A41D 13/0012; A45F 3/04; A45F 2003/045; A45F 3/06; A45F 3/08; A45F 3/14; A45F 2003/142; A45F 5/02

USPC ..... 2/69, 102, 101, 94, 312, 249, 251, 103, 2/2.5, 253, 321, 462; 24/3.7

See application file for complete search history.

(56) References Cited

U.S. PATENT DOCUMENTS

| | | | | |
|---|---|---|---|---|
| 4,993,076 | A * | 2/1991 | Dierickx | 2/463 |
| 5,185,195 | A * | 2/1993 | Harpell et al. | 428/102 |
| 5,724,707 | A | 3/1998 | Kirk et al. | |
| 6,108,816 | A | 8/2000 | Bradley | |
| 7,200,871 | B1 | 4/2007 | Carlson | |
| 7,448,115 | B2 | 11/2008 | Howell et al. | |
| 7,644,449 | B2 | 1/2010 | Hellweg | |
| 2003/0101508 | A1 * | 6/2003 | Marshall | 2/462 |
| 2006/0162135 | A1 | 7/2006 | Howell et al. | |
| 2006/0191110 | A1 | 8/2006 | Howell et al. | |
| 2006/0242799 | A1 * | 11/2006 | Flossner | 24/3.7 |
| 2009/0211000 | A1 * | 8/2009 | Roux | 2/462 |
| 2009/0282595 | A1 * | 11/2009 | Branson et al. | 2/2.5 |
| 2009/0307878 | A1 | 12/2009 | Kadas | |

OTHER PUBLICATIONS

Spec_Ops_10-26-2010small.pdf "Photograph of rear of SPEC-OPS brand MOLLE Accessory".

Extended European Search Report for EP11195541 dated May 20, 2014.

Partial European Search Report for EP11195541 dated Mar. 6, 2014.

* cited by examiner

*Primary Examiner* — Shaun R Hurley

*Assistant Examiner* — Andrew W Sutton

(74) *Attorney, Agent, or Firm* — Stiennon & Stiennon

(57) ABSTRACT

A MOLLE system compatible garment has a lightweight attachment structure with a skeleton of horizontal bands connected by a vertical bands. The garment has a unitary bearing frame assembly composed of a glued layup of a substrate which is adhered to an outside layer. The layup is cut to define holes delimiting horizontal bands interrupted at regular intervals by vertical bands presenting attachment points that correspond to those of a conventional PALS webbing system.

15 Claims, 3 Drawing Sheets

MOLLE COMPATIBLE LIGHTWEIGHT GARMENT

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to garments generally, and more particularly to lightweight utility garments which can accommodate various accessory elements.

Many active occupations require that practitioners have any number of specialized tools, supplies, and materials on their persons for ready use at any time. Soldiers and police officers, for example, must carry weapons, ammunition, lights, food and beverage, etc. Yet in most situations there is a desire to avoid the carriage of extraneous items which might unnecessarily reduce the speed, agility, and endurance of the carrier. Hence it is desirable that accessories be capable of speedy attachment and removal from the wearer's garment.

Various accessory systems are known for attaching pouches and other elements to belts, vests, or other garments. A standardized attachment system employed by US military services is the U.S. Army's PALS (Pouch Attachment Ladder System) arrangement, illustrated in FIG. 1. This system can be provided on a belt or a vest 20, is and employs horizontal rows 22 of 1" Mil-W-43668 Type III nylon webbing spaced 1" apart, and attached to a backing fabric panel 24 at 1.5" intervals. The PALS webbing defines an array of upwardly and downwardly opening loops 82. Pouches, pockets, holsters, and other accessories may be attached to the loops. Commonly, the PALS system is a component of a supporting vest such as those which are a part of the US Army's MOLLE (MOdular Lightweight Load-carrying Equipment) system.

Conventional MOLLE vests can interact with a wide variety of accessories and attachments which are configured for use with this standard arrangement of attachment points. Accessories attach to the loops with various hooks, straps or fasteners which engage with one or more of the loops. However, for the comfort and endurance of the wearer, it is desirable to reduce the weight of garments as much as possible.

SUMMARY OF THE INVENTION

The equipment carrying garment of the present invention offers a lightweight attachment structure which minimizes the material used by reducing the garment to a skeleton of horizontal bands connected by a few vertical bands. The garment employs a unitary bearing frame assembly which is composed of a glued layup of a substrate which is adhered to an outside layer. The layup is cut to define an array of holes delimiting horizontal bands interrupted at regular intervals by vertical bands. Such an arrangement may not have loops as such, but still is compatible with many PALS accessories, and is very lightweight.

It is an object of the present invention to provide a load supporting garment which is compatible with the MOLLE system which is very lightweight.

It is another object of the present invention to provide a load supporting garment which can be produced to accommodate attachments at any desired location.

Further objects, features and advantages of the invention will be apparent from the following detailed description when taken in conjunction with the accompanying drawings.

DESCRIPTION OF THE PREFERRED EMBODIMENTS

Figure 1:
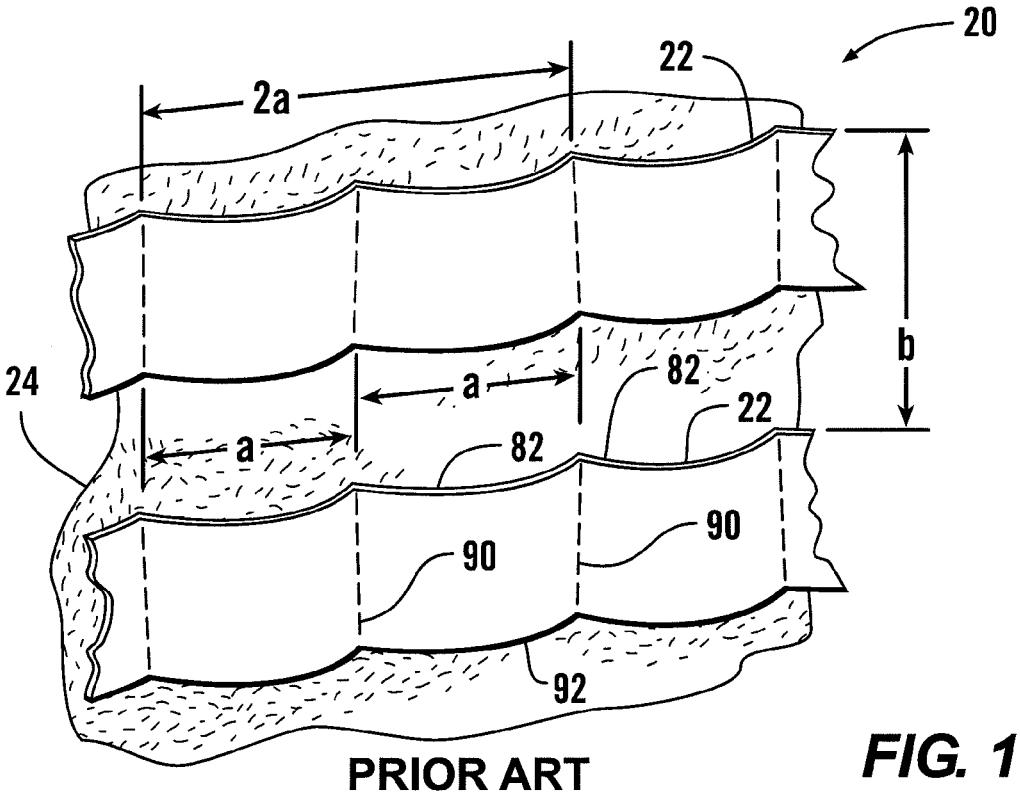
PRIOR ART FIG. 1
FIG. 1 is a schematic fragmentary view of a prior art PALS webbing system on a MOLLE garment.
Figure 2:
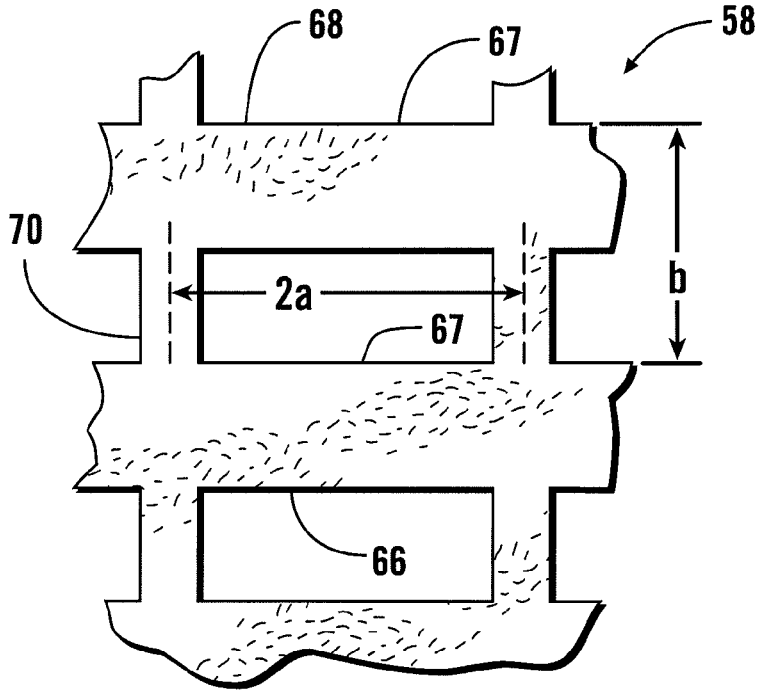
FIG. 2 is a schematic fragmentary front view of a portion of the garment of this invention.
Figure 3:
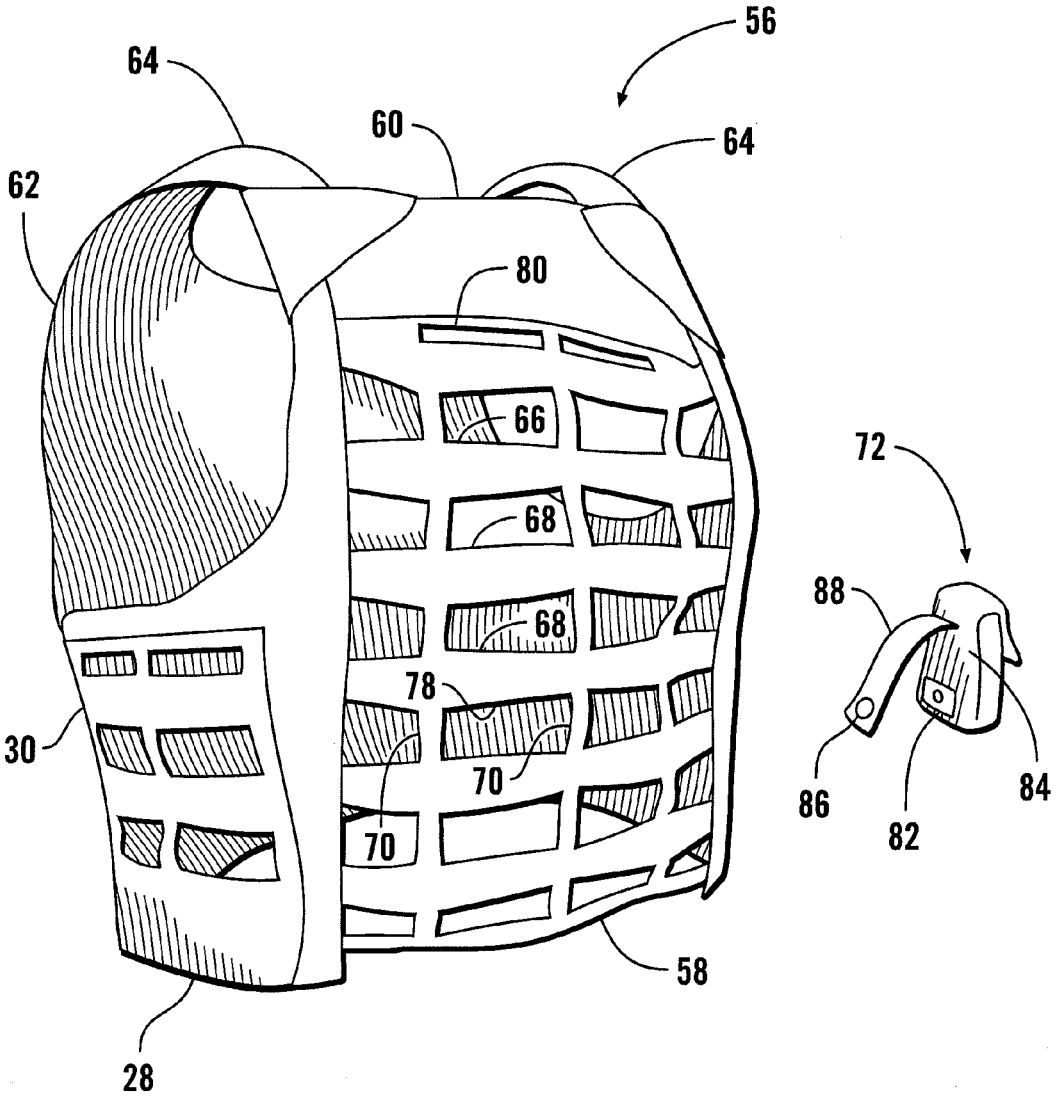
FIG. 3 is a perspective view of the equipment carrying garment of this invention.
Figure 4:
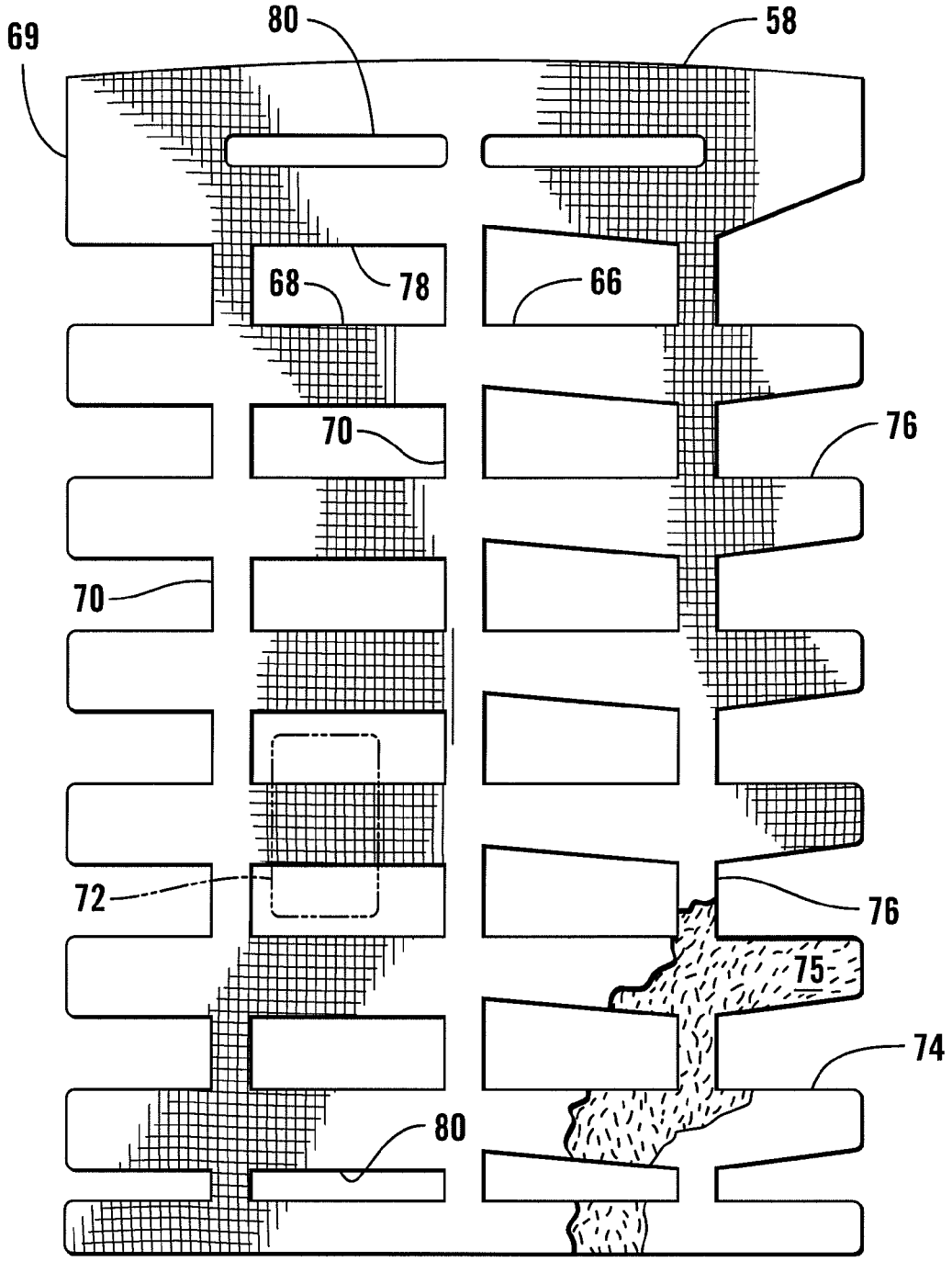
FIG. 4 is a front elevational view of a bearing frame of the equipment carrying garment of FIG. 3, partially broken away in section.

Referring more particularly to FIGS. 1-4, wherein like numbers refer to similar parts, an equipment carrying garment 56 is shown in FIGS. 2, 3 and 4 which uses a unitary bearing frame assembly 58 to achieve an effectively lightweight garment. The garment 56 is a vest with a front segment 60 joined to a rear segment 62 by two shoulder straps 64. The vest also has side portions 28. These elements are arranged to engage a wearer and to support the garment thereon. The bearing frame assembly 58 is shown in isolation in FIG. 4, prior to its incorporation into the garment 56. The bearing frame assembly 58 is essentially a composite sheet with an array of through holes 66 formed therein to define a plurality of vertically spaced horizontal bands 68, periodically interrupted by horizontally spaced vertical bands 70 which are about ⅛ to ½ inch wide. The vertical bands 70 provide integrity to the bearing frame assembly 58 and serve to support the loads which are imposed on the horizontal bands 68 by accessories such as the pouch 72, shown in FIG. 3. The vertical bands 70 extend vertically at least about one inch. The bearing frame assembly presents all the attachment points of a PALS system, but eliminates much of the backing fabric typically found in a MOLLE system garment, hence offering reduced overall weight and improved air circulation.

The side portions 28 include two smaller bearing frame assemblies 30 which extend between the vest front segment 60 and rear segment 62, one of the assemblies on the left side of the user, and one on the right side.

The horizontal bands 68 are preferably about one inch tall, and spaced one inch apart, to be compatible with MOLLE system accessories. The holes 66 include full height openings 78 which are about one inch tall, and about three inches wide (less the width of the vertical band 70), to correspond to the width of two conventional loops in a MOLLE system element. The holes 66 also include narrow slots 80, for example at the top of the bearing frame assembly 58, which are as wide as the full height openings 78, but which are merely of sufficient height to allow a strap or other attachment element of an accessory to access the horizontal band partially defined by the slot 80.

As shown in FIG. 4, the bearing frame assembly is comprised of a substrate 74 to which an exterior layer 76 is affixed. The substrate 74 may be formed of TEGRIS® material, a polypropylene thermoplastic composite with excellent impact resistance and stiffness and lightweight composition, manufactured by Milliken & Company of Spartanburg, S.C., or a material similar to the chlorosulfonated polyethylene material formerly manufactured by DuPont under the trademark HYPALON, which has a woven fabric core, and is covered in rubber. Alternatively, the substrate may be a singly woven nylon screen or mesh material. The exterior layer should be a lightweight, printable, and abrasion resistant material, such as the CORDURA® nylon fabric manufactured by the Invista subsidiary of Koch Industries, Inc. Thus the exterior layer may be printed with decoration or a camouflage pattern. The exterior layer may be attached to the substrate by a heat activated adhesive, for example the BEMIS themoplastic adhesive film manufactured by CDNT Company d/b/a Can-Do National Tape 195 Polk Avenue, Nashville, Tenn. The adhesive 75 may be applied as a thin film sheet between the substrate material and the exterior layer material, the composite being activated by exposure to temperatures of about 300 degrees F. Once the composite is thus formed, it may be cut to the desired configuration to add the through holes of the desired shape and location. The material may be die cut or laser cut, formed in a heat stamping process, or in any way that would be used for cutting fabric. It will be observed that although the holes may be arranged in a regular array to match the arrangement of a PALS system of webbing, it is not necessary that the horizontal bands be at the same level as they progress across the garment, and may be positioned in any arrangement desired.

The garment 56 thus presents a series of horizontal bands, in an array similar in location and spacing to those found in a conventional MOLLE garment, as illustrated in FIG. 1. The horizontal bands of the garment 56 match the conventional MOLLE PALS spacing of 1" wide horizontal bands separated by a 1" gap. The openings 66 thus define the vertically spaced horizontal bands 68, with one band spaced above another with an opening 66 positioned therebetween, the spacing between an upper perimeter 67 of one horizontal band and a upper perimeter of a horizontal band immediately below it being at least about two inches, such that MOLLE accessories may be received and attached to the horizontal bands. As long as this spacing between the top perimeters of the horizontal bands is maintained, there will be compatability with MOLLE accessories. Thus, as illustrated in FIG. 3, and in the right side of FIG. 4, the openings need not be strictly rectangular, but may be trapezoidal or other shape. However, in a preferred embodiment, the openings will all be generally rectangular.

A number of openings may be presented to replicate one to one the conventional MOLLE loops, with the distance between center lines defined by the vertical bands 70 being 1.5 inches. For increased weight savings, in a preferred embodiment, the openings 78 span a distance greater than 1.5 inches, preferably the length of two MOLLE openings, less the width of one vertical band 70. Thus while the distance a (about 1½ inches) between the sewn seams 90 of the prior art MOLLE garment shown in FIG. 1 defines one loop 92, the distance 2*a* shown in FIG. 2, is preferably greater than 1.5 inches to correspond to the distance between centers of two sequential vertical bands 70, or about three inches. In other words, the centerline spacing, for compatability with a MOLLE garment, should be a multiple of 1.5 inches.

It will be noted that the material used to construct the bearing frame assembly 58 makes it possible to duplicate the MOLLE PALS pattern in a single sheet, saving both the labor of stitching multiple pieces of webbing and the weight of that added webbing. The bearing frame assembly thus has a load bearing component with an outer cover. By employing a stiffer substrate it is possible to do with less material, and thereby have a garment of overall lower weight.

The prior art MOLLE PALS segment is conventionally made from a sheet of 500 denier CORDURA® material with 1" wide webbing sewn on one side. This system has an approximate areal density of 18 oz/square yard. The composite sheet material from which the present bearing frame assembly 58 is fabricated has an areal density of approximately 18.2 oz/square yard. Although the composite material sheet may have about the same or slightly greater areal density as the prior art assembly, by cutting the holes 66 out of the material, the bearing frame assembly 58 has less material per square yard of system coverage, and hence overall lower density which can result in a weight savings of 45 percent. If the substrate element is taken to have a perimeter 69 which encircles the substrate as constituted before the interior holes 66 are removed which defines a total surface area of the substrate, then all the holes 66 define an opening area.

The ratio of opening area to total surface area depends on whether the cut pattern of openings is carried to the edge of the sample, as shown in FIG. 4, or is terminated within the perimeter to maintain a solid border around the sample. If the cut pattern is carried out consistently, in a preferred embodiment 43% of the material is removed by the cut holes. It is possible to adjust the size of the uncut material and the cut pattern so that the ratio is as little as 25% or as large as 75%.

The preferred embodiment also can provide a single slot to take the place of two MOLLE garment loops. The material is stiff enough to support this gap between vertical supports without the excessive sagging that would be present if webbing were to span this distance. Yet the greater spacing also requires less material, which contributes to the reduction of the overall weight of the system.

It should be noted that, although the bearing frame assembly 58 is shown without attached loops, loops may be sewn on the interior or the exterior of the bearing frame assembly wherever desired.

In should be noted that the garment may be provided with a lightweight barrier fabric on the interior which is fastened to the bearing frame assembly 58 in such a way as not to interfere with the attachment of accessories to the bearing frame assembly, but which serves to prevent the passage of dust, debris, etc., through the bearing frame assembly openings onto the inner garments of the wearer.

It should be further noted that although the bearing frame assembly is shown as a composite of multiple layers, it could also be formed as a single layer of an appropriate material of sufficient strength and durability or printability.

An accessory 72, as shown in FIG. 3, may be attached to any desired horizontal band of the bearing frame assembly 58. The accessory 72 may be similar to the one shown in my Publication No. US-2009-0084822-A1, entitled Accessory Attachment System, the disclosure of which is incorporated by reference herein. A loop 82 is fastened to the rear wall 84 of the accessory 72 to define a passage between the rear wall and the loop which extends generally perpendicularly to the direction of the horizontal band. A first part of a two-part fastener 86 such as a snap is attached to an exterior surface of the loop. A strap 88 is fastened to the accessory rear wall spaced from the loop. A second part of the two-part fastener is configured to mate with the first part of the two-part fastener. The second part is fixed to the strap 88, so the strap is capable of passing through the loop 82, and around the loop to bring the first part and the second part of the fastener into engagement to retain the horizontal band between the strap and the accessory rear wall. The accessory 72 may thus readily be mounted to the garment 20, having loops, or to portions of the garment 56 having horizontal bands without loops.

It is understood that the invention is not limited to the particular construction and arrangement of parts herein illustrated and described, but embraces all such modified forms thereof as come within the scope of the following claims.

I claim:

1. A load supporting garment which is compatible with MOLLE accessories, comprising:

elements arranged to engage a wearer and to support the garment thereon; and a bearing frame assembly connected to said elements, the bearing frame assembly having a substrate to which a fabric exterior layer is adhered, the bearing frame assembly having portions defining a plurality of openings which extend through the substrate and the fabric exterior layer to define a plurality of vertically spaced horizontal bands, with one band spaced above another with a plurality of openings positioned therebetween, the openings extending vertically at least one inch, the spacing between an upper perimeter of one horizontal band and an upper perimeter of a horizontal band immediately below it being at least two inches, such that MOLLE accessories may be received and attached to the horizontal bands, and wherein the plurality of openings is positioned to define at least two vertical bands extending between two vertically spaced horizontal bands, the two neighboring vertical bands each having a vertical centerline, wherein the centerlines of the neighboring vertical bands are spaced horizontally at least 1.5 inches apart, the horizontal width of each vertical band being between ⅛ to ½ inches, such that the horizontal width of each opening is at least 1.5 inches less one half the combined widths of the neighboring vertical bands.

2. The load supporting garment of claim 1 wherein an upwardly extending centerline is defined by each vertical band, and wherein the horizontal distance between the centerlines of two neighboring vertical bands is three inches.

3. The load supporting garment of claim 1 wherein the exterior layer is adhered to the substrate by a sheet of heat fused adhesive.

4. The load supporting garment of claim 3 wherein the exterior layer has a camouflage pattern printed thereon.

5. The load supporting garment of claim 4 wherein the exterior layer comprises a nylon fabric which has the camouflage pattern printed thereon.

6. The load supporting garment of claim 1 wherein the substrate is formed of a polypropylene thermoplastic composite material.

7. The load supporting garment of claim 1 wherein the substrate is formed of a chlorosulfonated polyethylene material.

8. The load supporting garment of claim 1 wherein the substrate is formed of a woven nylon screen or mesh material.

9. The load supporting garment of claim 1 wherein the plurality of openings which extend through the substrate and the printed fabric exterior layer are laser cut therethrough.

10. The load supporting garment of claim 1 further comprising an accessory, wherein the accessory comprises:

a rear wall;

a strap fastened to the rear wall; and the strap extending around one of the two vertically spaced horizontal bands of the garment to thereby mount the accessory to the garment.

11. A load supporting garment and accessory arrangement, comprising:

elements arranged to engage a wearer and to support the garment thereon; and a bearing frame assembly connected to said elements, the bearing frame assembly having a substrate and a printed exterior layer adhered to the substrate, the bearing frame having portions defining a plurality of laser cut openings which extend through the substrate and the exterior layer, and portions between two vertically spaced openings which define a first horizontal band above a second horizontal band, the substrate being a material different from the material of the exterior layer, the first horizontal band being spaced from the second horizontal band such that MOLLE accessories may be received and attached to the horizontal bands; and further comprising an accessory, wherein the accessory comprises:

a rear wall;

a strap fastened to the rear wall; and the strap extending around one of the first and the second horizontal bands of the garment to thereby mount the accessory to the garment.

12. The load supporting garment and accessory arrangement of claim 11 wherein the substrate is formed of a woven nylon screen or mesh material.

13. The load supporting garment and accessory arrangement of claim 11 wherein the substrate is formed of a polypropylene thermoplastic composite material.

14. The load supporting garment and accessory arrangement of claim 11 wherein the substrate is formed of a chlorosulfonated polyethylene material.

15. The load supporting garment and accessory arrangement of claim 11 wherein the exterior layer comprises a nylon fabric which has a camouflage pattern printed thereon.

* * * * *